US010886088B2

(12) United States Patent
Mathieu et al.

(10) Patent No.: US 10,886,088 B2
(45) Date of Patent: Jan. 5, 2021

(54) PYROTECHNIC SWITCHING DEVICE

(71) Applicants: ARIANEGROUP SAS, Paris (FR); MERSEN FRANCE SB SAS, Saint-bonnet-de-mure (FR)

(72) Inventors: Alexandre Mathieu, Pibrac (FR); Romain Lorenzon, Eysines (FR); Jean-François De Palma, Saint-Barthelemy d'Anjou (FR); Rémy Ouaida, Villeurbanne (FR)

(73) Assignee: MERSEN FRANCE SB SAS, Saint-Bonnet-de-Mure (FR)

( * ) Notice: Subject to any disclaimer, the term of this patent is extended or adjusted under 35 U.S.C. 154(b) by 0 days.

(21) Appl. No.: 16/650,701

(22) PCT Filed: Sep. 25, 2018

(86) PCT No.: PCT/FR2018/052359
§ 371 (c)(1),
(2) Date: Mar. 25, 2020

(87) PCT Pub. No.: WO2019/063933
PCT Pub. Date: Apr. 4, 2019

(65) Prior Publication Data

US 2020/0321181 A1 Oct. 8, 2020

(30) Foreign Application Priority Data

Sep. 26, 2017 (FR) ..... 17 58899

(51) Int. Cl.
*H01H 85/02* (2006.01)
*H01H 39/00* (2006.01)

(52) U.S. Cl.
CPC ..... *H01H 85/0241* (2013.01); *H01H 39/004* (2013.01); *H01H 39/006* (2013.01)

(58) Field of Classification Search
CPC ..... G11C 17/00; G11C 17/16; G11C 17/18; G11C 29/00; G11C 29/785; H01H 39/00;
(Continued)

(56) References Cited

U.S. PATENT DOCUMENTS 3,793,501 A 2/1974 Stonestrom
2005/0083165 A1 4/2005 Tirmizi

FOREIGN PATENT DOCUMENTS

DE 197 49 896 A1 6/1999
DE 10 2009 023801 A1 2/2010
(Continued)

OTHER PUBLICATIONS

International Search Report as issued in International Patent Application No. PCT/FR2018/052359, dated Nov. 23, 2018.
(Continued)

*Primary Examiner* — Lincoln D Donovan
*Assistant Examiner* — Dave Mattison
(74) *Attorney, Agent, or Firm* — Pillsbury Winthrop Shaw Pittman LLP

(57) ABSTRACT

A pyrotechnic cut-off device to be connected to an electrical circuit to cut-off, includes a pyrotechnic initiator, a first and a second conductive portion each intended to be connected to the electrical circuit, the second portion being connected in parallel with the first portion and including two conductive elements separated by an insulating segment, at least one of the conductive elements provided with a first fuse element connected in series which is configured to trip when the intensity of the current passing therethrough exceeds a first predetermined value, and a first and a second insulating protrusion, each protruding from a lower face of a movable piston and the first and the second protrusions being located respectively in front of the first portion and the insulating segment. The pyrotechnic initiator is configured to switch
(Continued)

the cut-off device from a first current passage configuration to a second current cut-off configuration.

14 Claims, 6 Drawing Sheets

(58) Field of Classification Search
CPC .... H01H 39/004; H01H 39/006; H01H 85/00; H01H 85/0241; H01L 23/00; H01L 23/5252; H01L 23/5256
USPC ..... 327/525
See application file for complete search history.

(56) References Cited

FOREIGN PATENT DOCUMENTS

WO WO 2016/038043 A1 3/2016
WO WO 2016/038050 A1 3/2016

OTHER PUBLICATIONS

International Preliminary Report on Patentability and the Written Opinion of the International Searching Authority as issued in International Patent Application No. PCT/FR2018/052359, dated Mar. 31, 2020.

PYROTECHNIC SWITCHING DEVICE

CROSS-REFERENCE TO RELATED APPLICATIONS

This application is the U.S. National Stage of PCT/FR2018/052359, filed Sep. 25, 2018, which in turn claims priority to French patent application number 1758899 filed Sep. 26, 2017. The content of these applications are incorporated herein by reference in their entireties.

BACKGROUND OF THE INVENTION

The present invention relates to the general field of electrical cut-off devices, and more particularly those of the pyrotechnic actuation type. The invention also relates to an electrical system secured by such a device.

There are known pyrotechnic cut-off devices comprising a body in which a pyrotechnic initiator is present configured, when tripped, to set a piston in motion provided with a protrusion in the direction of a conductive bar to be cut. Documents WO 2016/038043 and WO 2016/038050 show examples of devices of this type. However, these devices can be subject, in particular when high voltages are used in the electrical circuit, to the formation of electric arcs. These electric arcs increase the time required to cut off the current in the circuit and generally reduce the reliability of the cut-off device.

To overcome the occurrence of these arcs, a fuse can be connected in parallel with the conductive bar of such devices. When the electrical circuit operates normally, the fuse and the conductive bar are conducting. When the initiator is tripped following the detection of an overcurrent, the piston cuts the conductive bar in order to cut off the current. After the initiator is tripped and the conductive bar is broken, all the current passes through the fuse, causing it to melt, and permanently cuts off the current in the circuit.

The use of this fuse allows reducing the occurrence of electric arc and using higher voltages in the electrical circuit to which the cut-off device is connected. This type of device generally operates effectively but, over time, the fuse can be subject to aging, which can ultimately affect its reliability.

There is therefore a need for a pyrotechnic cut-off device which is able to cut off the current, usable at high voltage, reducing the formation of electric arcs and having an improved lifetime compared to the devices of the prior art.

OBJECT AND SUMMARY OF THE INVENTION

The present invention therefore aims at overcoming such drawbacks by proposing a pyrotechnic cut-off device intended to be connected to an electrical circuit to cut off, the device comprising:

at least one pyrotechnic initiator, a first conductive portion and a second non-conductive portion each intended to be connected to the electrical circuit, the second portion being connected in parallel with the first portion and comprising two conductive elements separated by an insulating segment, at least one of the conductive elements being provided with a first fuse element connected in series which is configured to trip when the intensity of the current passing therethrough exceeds a first predetermined value, and a first insulating protrusion and a second conductive protrusion, each of the first and second protrusions protruding from a lower face of a movable piston, the first and second protrusions being located respectively in front of the first portion and the insulating segment, and said at least one pyrotechnic initiator being configured to switch the cut-off device from a first current passage configuration to a second current cut-off configuration, the first and second protrusions being set in motion upon switching from the first to the second configuration in order to disconnect the first portion through its breaking by impact with the first protrusion, and electrically connect the two conductive elements by the second protrusion no later than the time of disconnection of the first portion.

In normal operation (device in the first configuration), the electric current can circulate through the first portion but not through the second portion due to the presence of the insulating segment. Thus, no current passes through the first fuse element in normal operation, thus reducing the aging thereof. When an anomaly is detected, said at least one pyrotechnic initiator is tripped and the first and second protrusions are set in motion. Following this setting in motion, the first portion is disconnected by impact with the first protrusion and the two conductive elements of the second portion are connected by the second protrusion. The disconnection of the first portion allows cutting off the current circulating therein and the connection of the conductive elements authorizes the circulation of the current in the second portion, thereby tripping the first fuse element which permanently cuts off the current in the circuit. The disconnection of the first portion is carried out, simultaneously or subsequently, upon connection of the conductive elements so as to be able to thus divert, towards the second portion, the current circulating initially in the first portion, and thus end the cutoff by tripping of the first fuse element, while avoiding the generation of an electric arc within the second portion.

In one exemplary embodiment, the first fuse element comprises a fuse core present in an insulating shell.

The fact of using a fuse core with its insulating shell advantageously allows improving the strength over time of the fuse core, and in particular slowing down the phenomenon of spontaneous opening of the first fuse element, thus further improving the reliability of the cut-off device.

In one exemplary embodiment, the insulating segment is formed by a lack of material.

In one exemplary embodiment, the first portion is provided with a second fuse element connected in series, said at least one initiator being connected to the terminals of the second fuse element which is configured to trip when the intensity of the current passing therethrough exceeds a second predetermined value and to thus actuate said at least one initiator.

In this case, upon normal operation of the system, the second fuse element is conducting, the voltage across the second fuse element is relatively low and the current passing through the ignition device of the pyrotechnic initiator is sufficiently low so as not to actuate the latter. On the other hand, when the intensity of the current passing through the second fuse element exceeds the second predetermined value, the second fuse element trips, that is to say its resistance increases producing an increase in the voltage across the second fuse element. The intensity in the ignition device then increases, thus making it possible to actuate the pyrotechnic initiator and switch the device from the first to the second configuration in order to permanently cut off the circulation of the current in the circuit. This characteristic is advantageous in order to have a simplified cut-off solution by proposing an autonomous cut-off device directly integrating the element that will trip the cutoff, in this case the second fuse element. This advantageously allows dispensing with the presence of a third-party voltage/current sensor/analyzer device to allow the tripping of the initiator.

In one exemplary embodiment, the device comprises a chamber in which the first and second portions are present, a movable piston delimiting the chamber and comprising a lower face from which the first and second protrusions protrude, the distance separating the first portion from the first protrusion being greater than or equal to the distance separating the insulating segment from the second protrusion when the device is in the first configuration.

Such a characteristic is advantageous in order to improve the compactness of the cut-off device. In this case, the cut-off device constitutes a single pyrotechnic switch in which the first and second portions are present inside the same chamber and in which the first and second protrusions protrude from the lower face of the same movable piston.

Particularly, the first and second protrusions can extend from the lower face of the piston over identical lengths. As a variant, the first protrusion extends from the lower face of the piston over a first length different from a second length over which the second protrusion extends from said face.

Particularly, the insulating segment and the first portion may be present on the same transverse plane with respect to an axis of displacement of the piston. As a variant, the insulating segment and the first portion are offset along an axis of displacement of the piston.

As a variant, the device comprises at least:

- a first pyrotechnic switch comprising a first pyrotechnic initiator and a first movable piston comprising a lower face from which the first protrusion protrudes, and
- a second pyrotechnic switch, separate from the first pyrotechnic switch, comprising a second pyrotechnic initiator and a second movable piston comprising a lower face from which the second protrusion protrudes.

According to this variant, the device is in the form of two separate pyrotechnic switches, the first pyrotechnic switch being dedicated to the disconnection of the first portion, and the second pyrotechnic switch being dedicated to the connection of the second portion. In the latter case, the first protrusion and the second protrusion each protrude from the lower face of a separate movable piston.

The invention aims, according to another aspect, a secure electrical system comprising at least:

- a secure supply system comprising at least:
  - an electrical circuit, and
  - a cut-off device as described above, and
- an electrical device connected to said supply system and intended to be supplied by the latter.

In one exemplary embodiment, the system further comprises an electric generator configured to supply the circuit with an electric current having a first intensity, the rating of the first fuse element being less than or equal to this first intensity.

It is advantageous to implement a first low-rating fuse element in the system described above because it has a high sensitivity, and thus guarantees a very reliable cutoff.

The invention aims, according to yet another aspect, an electrical installation comprising a secure electrical system as described above.

BRIEF DESCRIPTION OF THE DRAWINGS

Other characteristics and advantages of the present invention will emerge from the description given below, with reference to the appended drawings that illustrate exemplary embodiments without any limitation. In the figures.

DETAILED DESCRIPTION OF THE INVENTION

Figure 1A:
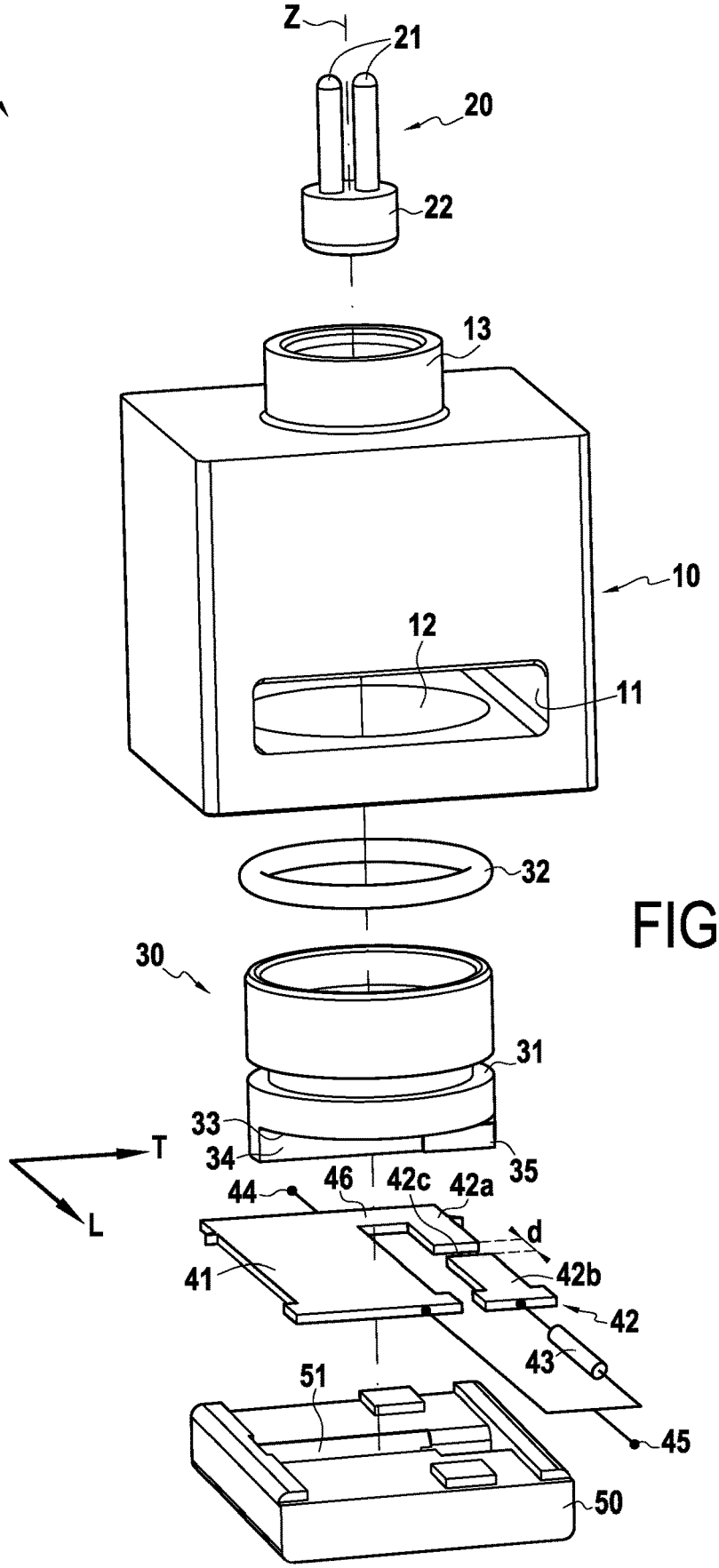
FIGS. 1A and 1B are exploded and schematic perspective views of a cut-off device according to one embodiment of the invention, FIG. 2 schematically shows the device of FIGS. 1A and 1B in the first configuration in cross-section along a plane perpendicular to an axis connecting the two terminals of the device, FIGS. 3A and 3B schematically show respectively the device of FIGS. 1A and 1B just after the tripping of the pyrotechnic initiator and in the second configuration.
Figure 1B:
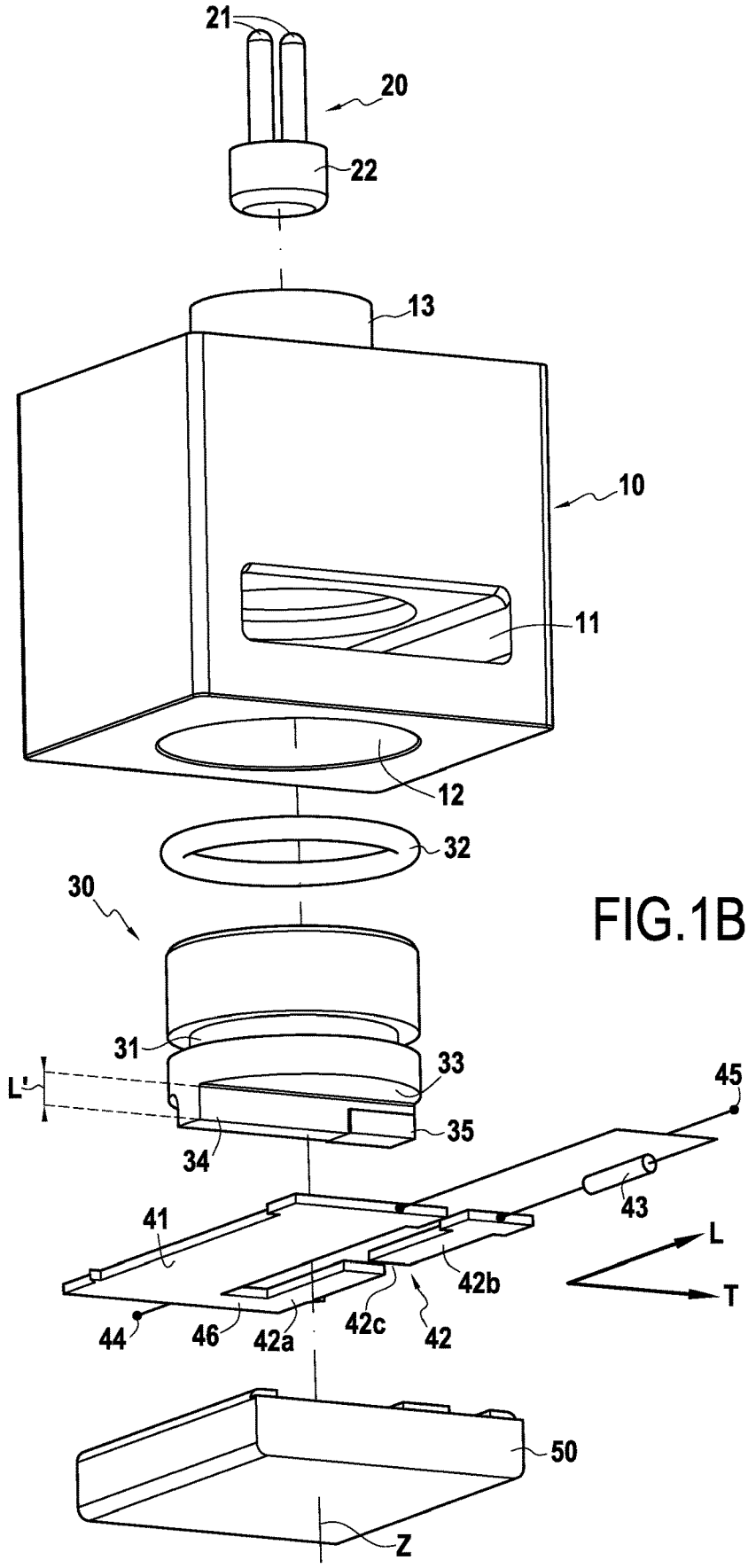

FIGS. 1A and 1B show two exploded views of a cut-off device 1 according to one embodiment of the invention. The illustrated cut-off device 1 comprises: a body 10, a pyrotechnic initiator 20, a piston 30, a first conductive portion 41, a second portion 42, a first fuse element 43 and a support 50. In the illustrated example, the longitudinal direction L corresponds to the direction along which the portions 41 and 42 extend and connecting the terminals 44 and 45 of the device 1. The transverse direction T is perpendicular to this direction L in the plane of the portions 41 and 42.

The device 1 comprises a first 44 and a second 45 electrical terminal which are intended to be connected to an electrical circuit to be cut off. The first conductive portion 41 and the second portion 42 are mounted in parallel with each other between the first terminal 44 and the second terminal 45 of the cut-off device. The first conductive portion 41 electrically connects the first terminal 44 to the second terminal 45. The second portion 42 connects the first terminal 44 to the second terminal 45. The first 41 and second 42 portions are each connected to the same electrical circuit. One example of assembly comprising an electrical circuit will be described in connection with FIG. 5. In this example, the first 41 and second 42 portions are present inside the same body 10. The cut-off device 1 here constitutes one and the same pyrotechnic switch.

The second portion 42 comprises a first 42*a* and a second 42*b* conductive element which are separated by an insulating segment 42*c*. In this example, the first conductive element 42*a* is formed in one piece (monolithically) with the first conductive portion 41. An intermediate conductive portion 46 can connect the first portion 41 and the first element 42*a*. This intermediate portion 46 can be directly connected to the first portion 41 and to the first element 42*a*. The first element 42*a* can be located on the side of the first terminal 44 and the second element 42*b* can be located on the side of the second terminal 45. In the illustrated example, the insulating segment 42*c* is formed by a lack of material. According to this example, the first conductive element 42*a* is spaced from the second conductive element 42*b* by a non-zero distance d. According to one variant, not illustrated, the insulating segment could be formed by a portion of an insulating material added between the conductive elements of the second portion.

When the device 1 is in the first configuration, the first portion 41 allows the conduction of the current but the second portion 42 does not allow the conduction of the current due to the presence of the insulating segment 42*c*. In other words, when the device 1 is in the first configuration, the current circulates only in the first portion 41 and not in the second portion 42.

In the illustrated example, a first fuse element 43 is mounted in series with the second element 42*b*. The first fuse element 43 is here present between the insulating segment 42*c* and the second terminal 45. The first fuse element 43 here comprises a fuse core present in an electrically insulating shell. The insulating shell may contain a powder of an electrically insulating material, such as silica, inside which the fuse core is present. The fact of using a fuse core with its insulating shell advantageously allows improving the strength over time of the fuse core, and in particular slowing down the phenomenon of spontaneous opening of the latter, thus further improving the reliability of the cut-off device. As a variant, it is possible to integrate to the second element 42*b* only the fuse element of a commercial fuse (without its insulating shell).

According to one variant, not illustrated, the first fuse element could be mounted in series with the first conductive element 42*a*, and in which case be present between the insulating segment 42*c* and the first terminal 44. Of course, this is does not depart from the scope of the invention if the two conductive elements are each provided with a fuse element.

In the illustrated example, the first conductive portion 41 can be connected to the second terminal 45 by a conductive wire, and the second element 42*b* can be connected to the first fuse element 43 by a conductive wire. Of course, the first fuse element 43 can be disposed differently, for example integrated to one end of the second conductive portion 42 or positioned in a housing inside the body 10.

The first conductive portion 41 and each of the conductive elements 42*a* and 42*b* here take the form of a bar or a flattened conductive tab.

The body 10 here has a generally parallelepiped shape. The body 10 comprises a lateral opening 11 through which the support 50 is intended to be inserted inside the body 10, a generally circular lower opening 12 through which the piston 30 is intended to be inserted inside the body 10, and an upper opening 13 protruding on an upper face of the body 10 through which the initiator 20 is intended to be inserted inside the body 10. The lateral opening 11 extends along the longitudinal direction L inside the body 10 to form a housing in which the support 50 is held in the body 10.

The pyrotechnic initiator 20 comprises two conductive elements 21 configured to initiate a pyrotechnic charge 22 to which they are connected. The pyrotechnic charge 22, when initiated for example using a current passing through the conductive elements 21, is able to generate a pressurization gas through its combustion. The conductive elements 21 can be connected to a control device C (cf. FIG. 5) configured to actuate the pyrotechnic initiator 20 when an anomaly is detected.

The piston 30 is, in this example, cylindrical in shape and centered on a vertical axis Z. The axis Z here corresponds to the axis of displacement of the piston 30. The piston 30 comprises a circumferential groove 31 in which a seal 32, for example an O-ring, is intended to be housed. The piston 30 can move along the axis Z inside the body 10 between a high position (first position, device in the first configuration), as in FIGS. 2 and 3A, and a low position (second position, device in the second configuration), as in FIG. 3B. As long as the pyrotechnic initiator 20 has not been tripped, the piston 30 is kept in the high position. Of course, the piston 30 may have shapes different from the one illustrated, adapted to the shape of the cavity inside the body.

Figure 2:
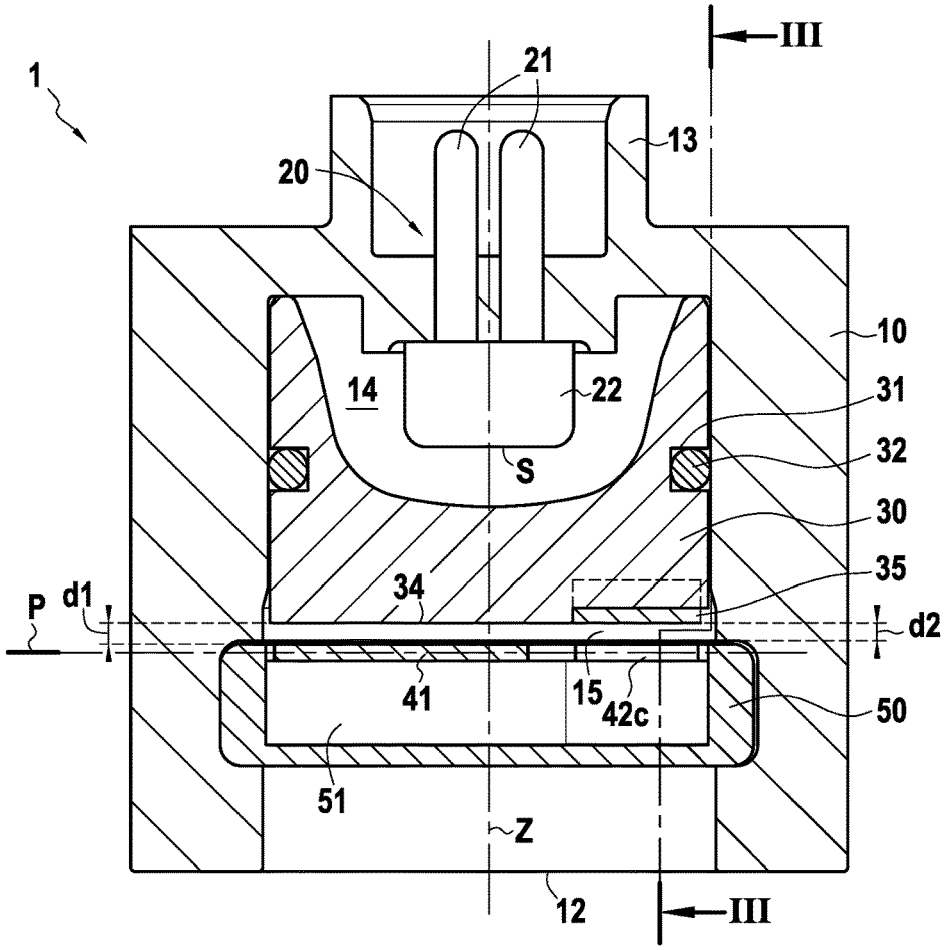

As illustrated in FIG. 2, the body 10 here comprises a first pressurization chamber 14 in communication with an outlet S of the pyrotechnic initiator 20, and a second chamber 15 in which the portions 41 and 42 are present. The piston 30 separates the first chamber 14 from the second chamber 15. The seal 32 allows making a hermetic separation of these chambers 14 and 15.

The piston 30 here comprises a lower face 33 from which a first protrusion 34 and a second protrusion 35 protrude. In this example, the first 34 and the second 35 protrusions are carried by the same piston 30, but without departing from the scope of the invention when this is not the case, as will be described below in connection with FIG. 9. The first protrusion 34 and the second protrusion 35 are located respectively in front of the first conductive portion 41 and the insulating segment 42*c*. The first protrusion 34 is superimposed on the first portion 41 when the device is in the first configuration. The second protrusion 35 is superimposed on the insulating segment 42*c* when the device is in the first configuration. The first protrusion 34 is electrically insulating and the second protrusion 35 is electrically conductive. The second protrusion 35 can for example be formed by adding, in a manner known per se, a conductive part onto the insulating material forming the first protrusion 34.

The protrusions 34 and 35 generally extend here along the transverse direction T. Each protrusion 34 and 35 may have a dimension, along the transverse direction T, which is greater than the dimension, along this same direction T, of the corresponding portion 41 or 42 in front of which it is positioned. Of course, the protrusions 34 and 35 could be separated from each other and have a dimension, along the transverse direction T, substantially equal to the dimension, along this same direction T, of the corresponding portion in front of which it is positioned.

In the example discussed here and as illustrated in FIG. 1B, the first protrusion 34 extends from the lower face 33 of the piston 30 over a length L' equal to the length L' on which the second protrusion 35 extends from this same face 33. The length L' is, unless otherwise stated, measured along the axis Z of displacement of the piston 30. Furthermore in this example, the insulating segment 42*c* and the first portion 41 are present on a same plane P transverse with respect to the axis Z, for example perpendicular to the axis Z (see FIG. 2). Other configurations are possible as will be described below, in connection with FIGS. 6 and 7.

The support 50 takes, in the illustrated example, the form of a slide on which the portions 41 and 42 are present. In the illustrated example, the support 50 is configured to hold in position the conductive portions 41 and 42 in the device 1, for example by arranging corresponding housings therein. The support 50 is here provided with a groove 51 which extends in the transverse direction T in which the protrusions 34 and 35 are intended to be housed after tripping of the pyrotechnic initiator 20 when the device is in the second configuration. The groove 51 in the support thus allows locking the piston 30 in the second position and ensuring a permanent cutoff of the conductive portions 41 and 42.

When the device is in the first configuration, the first protrusion 34 is spaced from the first portion 41 by a first distance $d_1$ (see FIG. 2). When the device is in the first configuration, the second protrusion 35 is spaced from the insulating segment 42*c* by a second distance $d_2$ (see FIG. 2). The distances $d_1$ and $d_2$ are, unless otherwise stated, measured along the axis Z of displacement of the piston 30. In the example illustrated here, the first distance $d_1$ is equal to the second distance $d_2$.

In this way, when the pyrotechnic initiator 20 is tripped, the piston 30 moves along the direction Z in the direction of the portions 41 and 42 in order to switch the device from the first to the second configuration. The first protrusion 34 cuts the first conductive portion 41 and the second protrusion 35 is inserted between the two conductive elements 42*a* and 42*b*. When the device is in the second configuration, the second protrusion 35 occupies the area which was initially occupied by the insulating segment 42*c*. When the device is in the second configuration, the second protrusion 35 can be bearing on the conductive elements 42*a* and 42*b*, or even deform them.

Since the first distance $d_1$ is equal to the second distance $d_2$, when the first conductive portion 41 is cut, the current is diverted towards the second conductive portion 42 which has been made conductive by interposing the second protrusion 35 between the conductive elements 42*a* and 42*b*. The current thus diverted then causes the first fuse element 43 to melt, thus permanently cutting off the circulation of the current in the first and second conductive portions 41 and 42.

Figure 3A:
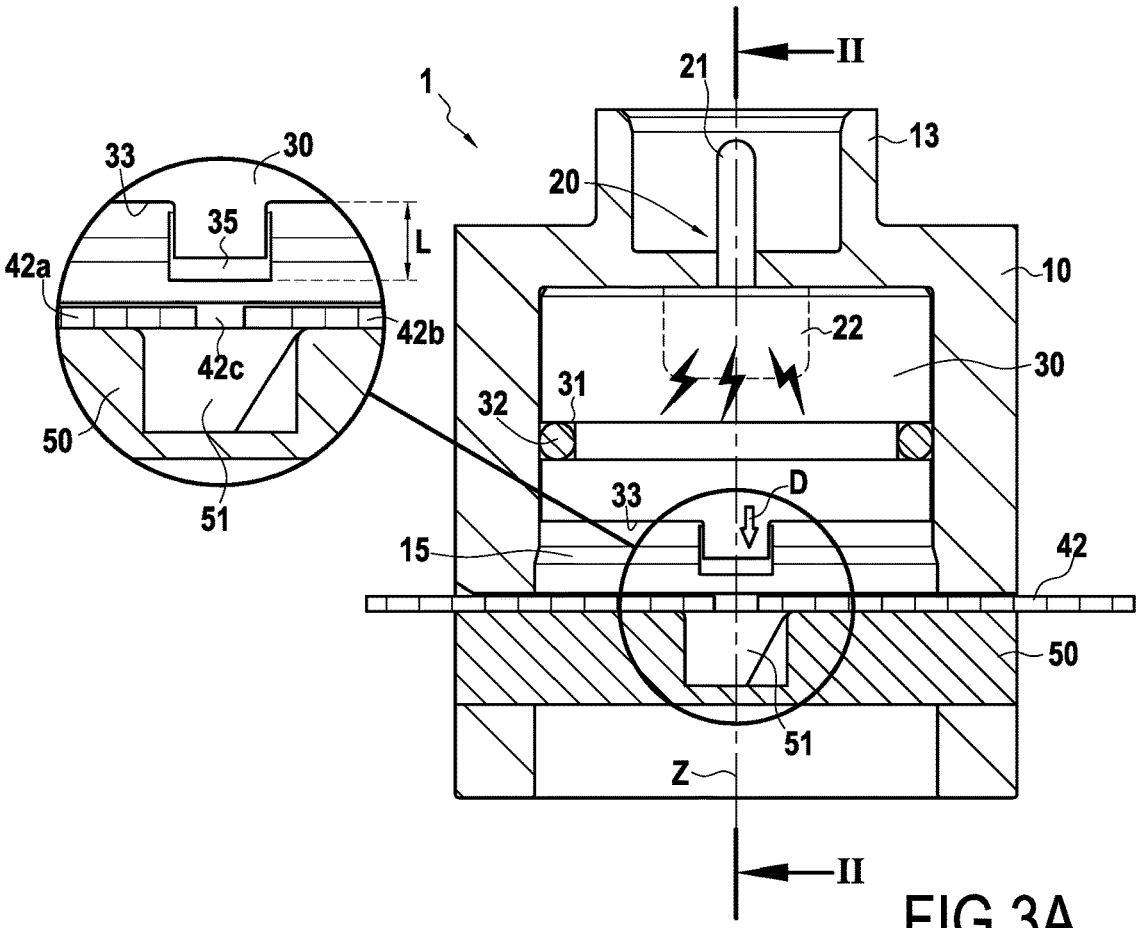
Figure 3B:
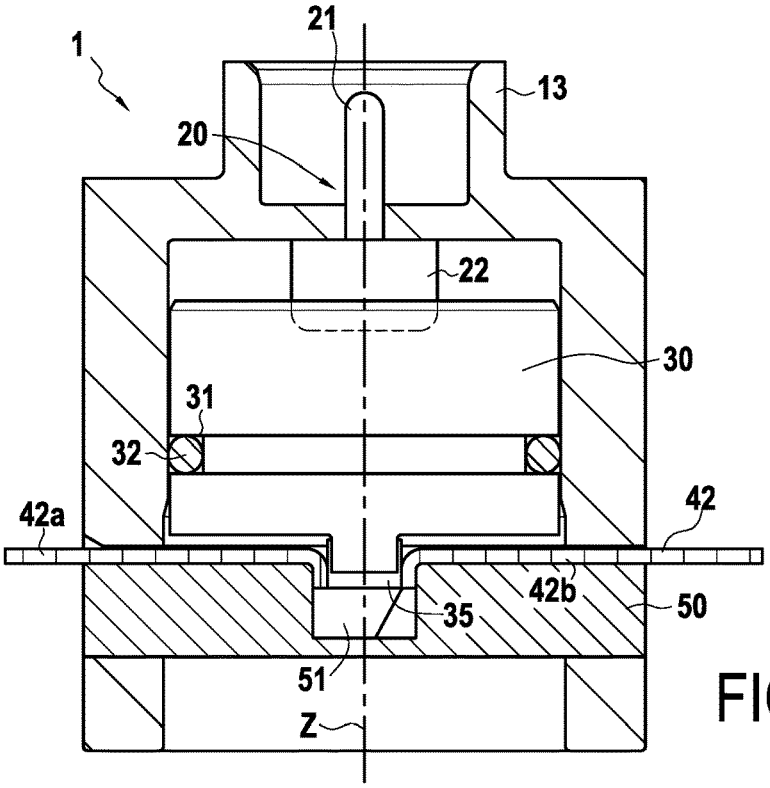
Figure 4A:
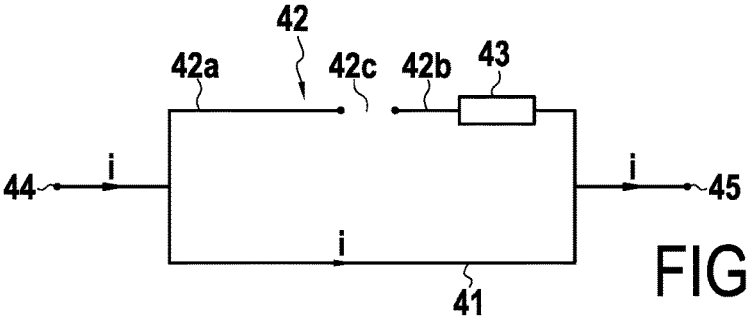
FIG. 4A is a simplified electrical diagram associated with the device in the state illustrated in FIG. 3A.
Figure 4B:
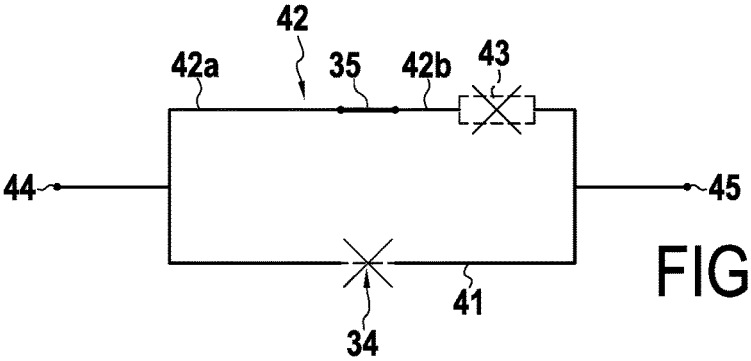
FIG. 4B is a simplified electrical diagram associated with the device in the state illustrated in FIG. 3B, FIG. 5 schematically shows one example of a secure electrical system comprising the device of FIGS. 1A and 1B, FIGS. 6 and 7 schematically and partially represent variants of cut-off devices according to the invention, FIG. 8 schematically shows a secure electrical system implementing one variant of the cut-off device according to the invention, and FIG. 9 schematically shows a secure electrical system implementing another variant of the cut-off device according to the invention.

These operating steps are illustrated in FIGS. 3A, 3B, 4A and 4B. FIGS. 3A and 3B are sectional views along a plane perpendicular to the cutting plane of FIG. 2 and containing the axis Z of displacement of the piston 30. FIG. 3A represents the device 1 in the first configuration (piston in the first position or high position), that is to say before tripping of the pyrotechnic initiator 20. FIG. 4A corresponds to the simplified electrical diagram associated with this first configuration: in this configuration, the first portion 41 is conductive (possible circulation of the current i) and the second portion 42 is not conductive (no possible circulation of the current).

Following the tripping of the pyrotechnic initiator 20, the chamber 14 is pressurized by the gases derived from the combustion of the pyrotechnic charge 22, the piston 30 is set in motion towards the portions 41 and 42 by following the direction Z (arrow D). The first protrusion 34 then impacts the first conductive portion 41, leading to its breaking and to the stopping of the circulation of the current in this portion. The current is then totally diverted in the second conductive portion 42 and then passes through the first fuse element 43 (not represented here) in order to ensure its melting and to carry out the permanent cutoff of the current (see FIG. 4B which corresponds to the simplified electrical diagram associated with the second cut-out configuration). Of course, the rating of the fuse is chosen so as to obtain this cutoff when part or all of the current is diverted in the second conductive portion 42 due to the breaking of the first conductive portion 41.

At the end of stroke of the piston 30, in the second position or low position, the protrusions 34 and 35 are housed in the groove 51 of the support 50 (FIG. 3B).

Figure 5:
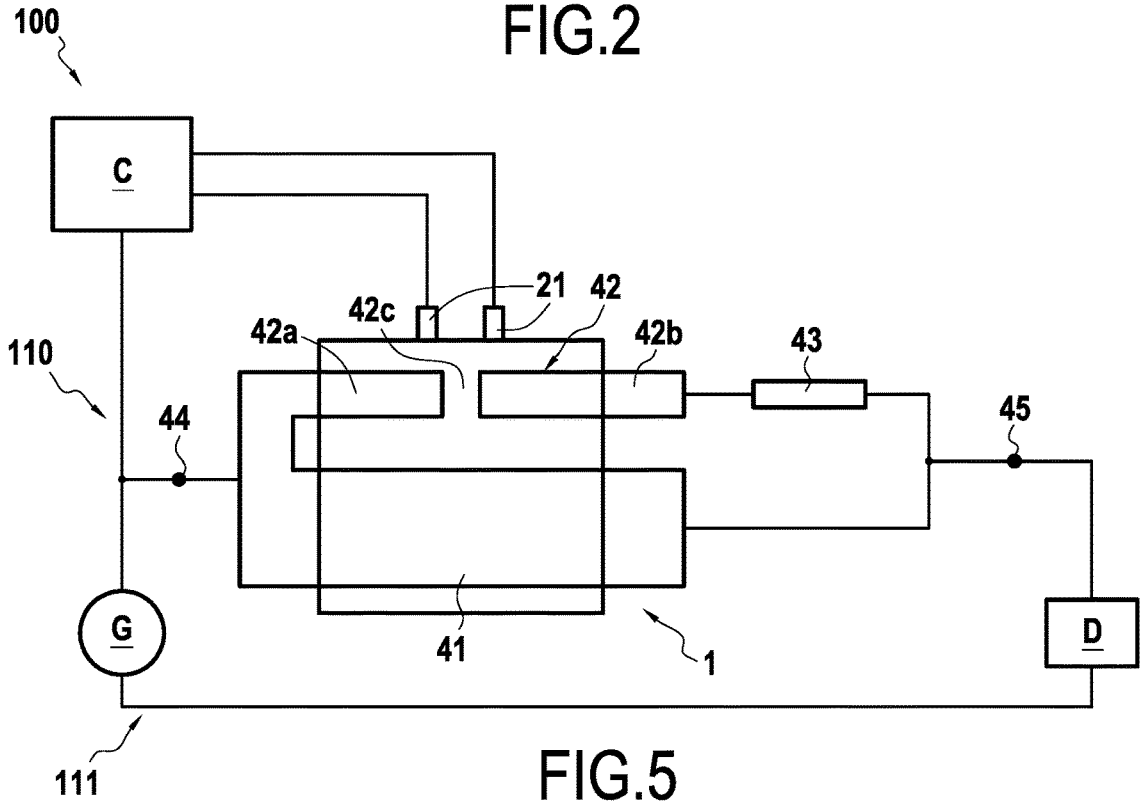

FIG. 5 shows one example of secure electrical system 100 implementing one example of cut-off device 1 according to the invention. The secure electrical system comprises a secure supply system 110 comprising a cut-off device 1 and an electrical circuit 111. The electrical circuit 111 here comprises an electric generator G connected to the first terminal 44 of the cut-off device 1.

The secure electrical system 100 further comprises an electrical device D connected, on the one hand, to the generator G to be supplied by the latter and, on the other hand, to the second terminal 45 of the cut-off device 1.

The secure electrical system 100 further comprises a control device C configured to actuate the pyrotechnic initiator 20 when an anomaly is detected.

The control device C is connected to the pyrotechnic initiator 20 via the conductors 21. In the illustrated example, the control device C is connected to the circuit 111 to detect that a current threshold has been exceeded. In this case, when the control device C detects an intensity of the current circulating in the first portion 41 greater than a threshold value, the pyrotechnic initiator 20 is actuated and the current is cut off in the manner described above.

The anomaly giving rise to the current cutoff may be of another type than an overcurrent and in particular be a non-electrical anomaly such as the detection of an impact, a change in temperature, in pressure, etc. In case of detection of anomaly, the control device C is able to send an electrical signal to the pyrotechnic initiator 20 for its tripping in order to cut off the current in the circuit 111, as described above. In the latter case, the use of a first low-rating fuse element may be perfectly suitable.

An example of a device in which the first and second protrusions 34 and 35 extend over the same length L' has just been described, without however departing from the scope of the invention when this is not the case.

Figure 6:
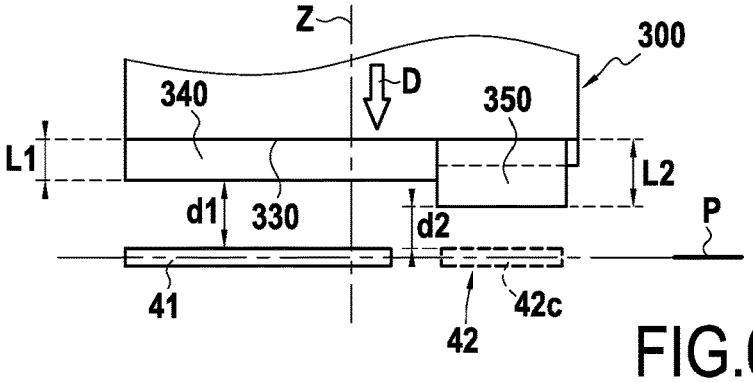

As such, FIG. 6 schematically and partially shows a sectional view transverse to the direction L of a variant of the cut-off device in the first configuration. According to this variant, the first insulating protrusion 340 extends from the lower face 330 of the piston 300 over a length L1 strictly smaller than the length L2 over which the second conductive protrusion 350 extends from this same face 330. The lengths L1 and L2 are, unless otherwise stated, each measured along the axis Z of displacement of the piston 30.

In this variant of FIG. 6, the first distance $d_1$ separating the first portion 41 from the first protrusion 340 is strictly greater than the second distance $d_2$ separating the insulating segment 42*c* from the second protrusion 350. In this variant, when the pyrotechnic initiator is tripped, the piston 300 moves along the direction Z (along the arrow D) in the direction of the conductive portion 41 and of the insulating segment 42*c*. The electrical connection of the two conductive elements of the second portion 42 is first made by the second protrusion 350 in the same way as above, and then the first portion 41 is cut by the first protrusion 340. Upon cutting of the first portion 41, the entire circulating current is then diverted in the second portion 42, thus tripping the first fuse element and the permanent cutoff of the current. In this example, the first protrusion 340 impacts the first portion 41 for a certain predefined time after electrical connection of the two conductive elements by the second protrusion 350.

In the examples that have just been described, the insulating segment 42*c* and the first portion 41 are present on the same plane P transverse with respect to the axis Z of displacement of the piston 30, without however departing from the scope of the invention when this is not the case, as it will now be described in relation to FIG. 7.

Figure 7:
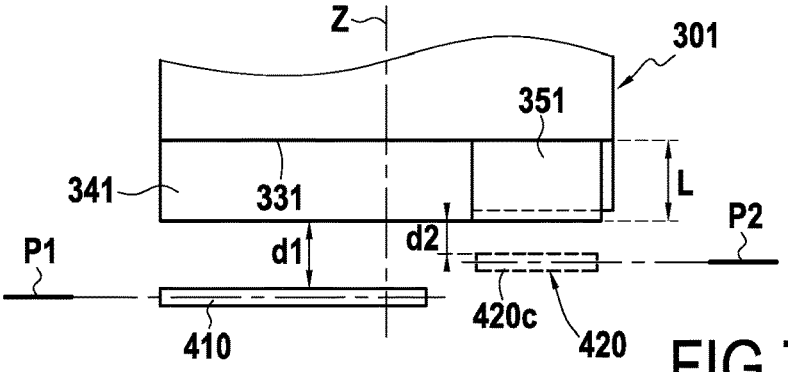

In the example of FIG. 7, the first 341 and second 351 protrusions extend from the lower face 331 of the piston over the same length L'. The first portion 41 is present on a first plane P1 transverse with respect to the axis Z of displacement of the piston 301, or even perpendicular to this axis Z. The insulating segment 420*c* is present on a second plane P2 transverse with respect to the axis Z of displacement of the piston 301, even perpendicular to this axis Z. The first plane P1 is spaced from the second plane P2 by a non-zero distance. Thus, the insulating segment 420*c* and the first portion 410 are offset along the axis Z of displacement of the piston 301. According to this example, the second portion 420 is connected then the first broken portion 410 and the permanent cutoff of the current is then obtained by tripping of the first fuse element, as described above.

Examples of cut-off device in which only the second portion is provided with a fuse element have just been described and the actuation of the pyrotechnic initiator is carried out by a control device, separate from the cut-off device, without however departing from the scope of the invention when this is not the case, as will now be described in relation to FIG. 8.

Figure 8:
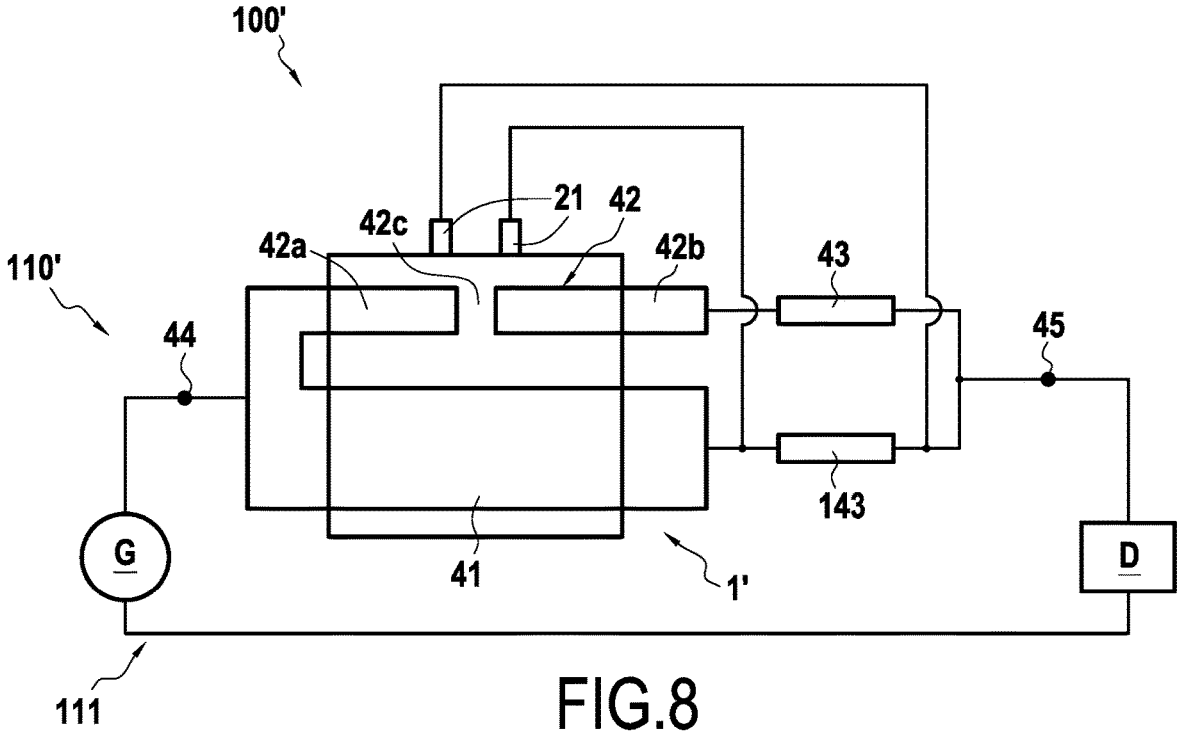

FIG. 8 illustrates one variant in which the secure electrical system 100' comprises a secure supply system 110' comprising an autonomous cut-off device 1', making it possible to trip the cutoff without requiring the use of a separate control device C.

According to the variant of FIG. 8, the first portion 41 of the device 1' is provided with a second fuse element 143 connected in series. The second fuse element 143 is present between the terminals 44 and 45 of the cut-off device 1'. The pyrotechnic initiator is connected to the terminals of the second fuse element 143 which is configured to trip when the intensity of the current passing therethrough exceeds a second predetermined value. The tripping of the second fuse element 143 thus allows actuating the pyrotechnic initiator and tripping the cutoff of the current in the circuit.

The rating of the second fuse element 143 may be less than, equal to or greater than the rating of the first fuse element 43. As for the first fuse element 43, the second fuse element 143 may comprise a fuse core present in an insulating shell or only a commercial fuse element fuse (without its insulating shell).

Examples in which the cut-off device is in the form of one and the same pyrotechnic switch have just been described, the first and second portions being both present in the same chamber, and the first and second protrusions being carried by the same piston delimiting this chamber. The cut-off device comprises, in these examples, a single pyrotechnic initiator making it possible to set the piston in motion in order to switch the device from the first to the second configuration, without however departing from the scope of the invention when the cut-off device comprises two separate pyrotechnic switches, each intended to act on only one of the first and second portions. Such a variant will now be described in relation to FIG. 9.

Figure 9:
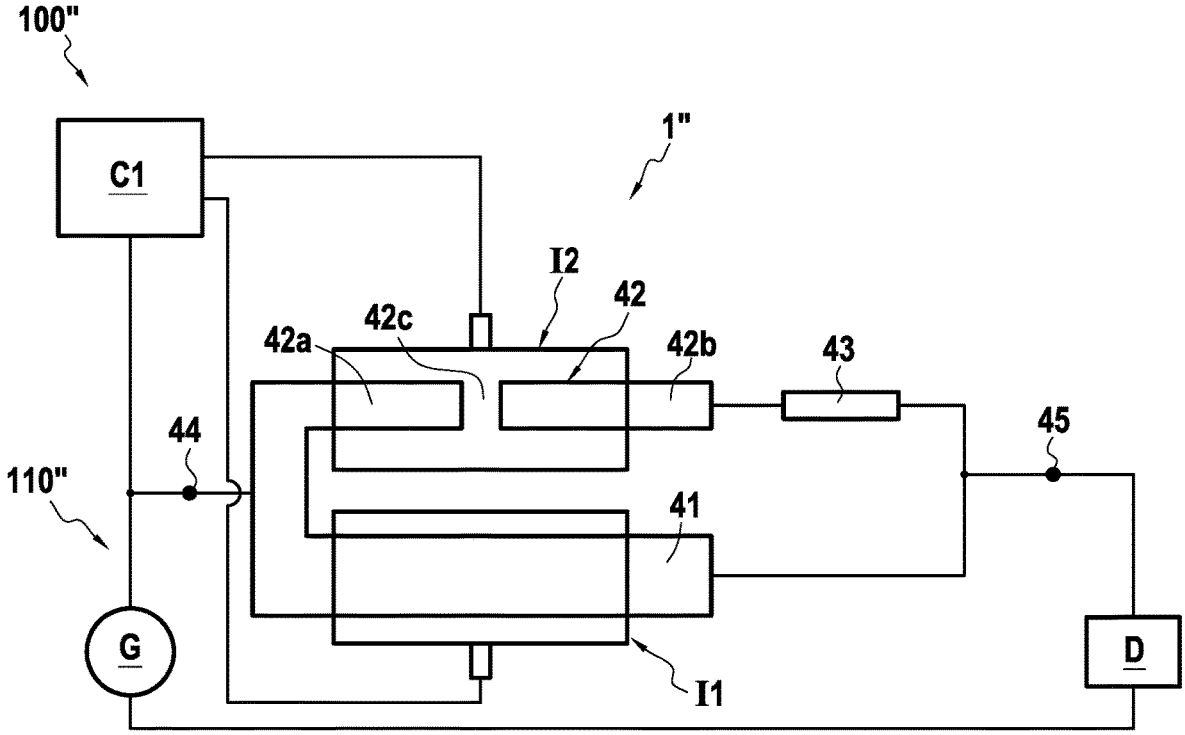

In the electrical system 100" in FIG. 9, the supply system 110" comprises a cut-off device 1" comprising two separate pyrotechnic switches I1 and I2. The first pyrotechnic switch I1 comprises a first pyrotechnic initiator and a first piston carrying the first protrusion intended to break the first portion 41. The cut-out device 1" further comprises a second pyrotechnic switch I2 comprising a second pyrotechnic initiator and a second piston carrying the second protrusion intended to connect the second portion 42. The cut-off device 1" here comprises a control device C1, distinct from the first I1 and second I2 pyrotechnic switches, which allows actuating the first and second pyrotechnic initiators simultaneously or with a predetermined delay relative to each other.

The actuation of the first pyrotechnic initiator I1 allows setting in motion the first piston carrying the first protrusion in order to break the first portion 41. The actuation of the second pyrotechnic initiator I2 allows setting in motion the second piston carrying the second protrusion in order to connect the conductive elements 42*a* and 42*b*. This connection of the conductive elements 42*a* and 42*b* by the second protrusion is carried out no later than the time of disconnection of the first portion 41.

It will be particularly noted in this example that it is possible but not necessary that the distance separating the first portion from the first protrusion is greater than or equal to the distance separating the insulating segment from the second protrusion when the device 1" is in the first configuration. The actuation of the pyrotechnic initiators of the switches I1 and I2 being not necessarily carried out simultaneously, it is not imperative that this condition on the distances is verified when the device is in the first configuration.

Similarly to what has been described above in relation to FIG. 8, it is possible, in one variant of the device in FIG. 9, to provide the first portion with a second fuse element making it possible to carry out the actuation during an overcurrent in the circuit.

According to one variant, the control device C1 is configured to actuate the first pyrotechnic switch I1 and the second pyrotechnic switch I2 when it detects an intensity of the current circulating in the first portion 41 greater than a first threshold value, and the control device being further configured to actuate only the first pyrotechnic switch I1 when it detects an intensity of the current circulating in the first portion 41 comprised between a second threshold value and the first threshold value, the second threshold value being lower than the first threshold value. Thus, in this case, in case of strong current (first threshold value) circulating in the first portion 41, the control device C1 performs the cutoff as detailed above by actuating the two pyrotechnic switches I1 and 12. The first threshold value is sufficient to trip the fuse element 43 which ends the cutoff. However, the control device C1 can open the first portion only (without tripping the second switch 12 and therefore without affecting the second portion) when a lower current (second threshold value) passes through the first portion 41.

The invention claimed is:

1. A pyrotechnic cut-off device intended to be connected to an electrical circuit to cut off, the device comprising:

at least one pyrotechnic initiator, a first conductive portion and a second non-conductive portion each intended to be connected to the electrical circuit, the second portion being connected in parallel with the first portion and comprising two conductive elements separated by an insulating segment, at least one of the conductive elements being provided with a first fuse element connected in series which is configured to trip when the intensity of the current passing therethrough exceeds a first predetermined value, and a first insulating protrusion and a second conductive protrusion, each of the first and second protrusions protruding from a lower face of a movable piston and the first and the second protrusions being located respectively in front of the first portion and the insulating segment, and said at least one pyrotechnic initiator being configured to switch the cut-off device from a first current passage configuration to a second current cut-off configuration, the first and second protrusions being set in motion upon switching from the first to the second configuration in order to disconnect the first portion through its breaking by impact with the first protrusion, and electrically connect the two conductive elements by the second protrusion no later than the time of disconnection of the first portion.

2. The device according to claim 1, wherein the first fuse element comprises a fuse core present in an insulating shell.

3. The device according to claim 1, wherein the insulating segment is formed by a lack of material.

4. The device according to claim 1, wherein the first portion is provided with a second fuse element connected in series, said at least one initiator being connected to the terminals of the second fuse element which is configured to trip when the intensity of the current passing therethrough exceeds a second predetermined value and to thus actuate said at least one initiator.

5. The device according to claim 1, wherein the device comprises a chamber in which the first and second portions are present, a movable piston delimiting the chamber and comprising a lower face from which the first and second protrusions protrude, a distance separating the first portion from the first protrusion being greater than or equal to a distance separating the insulating segment from the second protrusion when the device is in the first configuration.

6. The device according to claim 5, wherein the first and second protrusions extend from the lower face of the piston over identical lengths.

7. The device according to claim 5, wherein the first protrusion extends from the lower face of the piston over a first length different from a second length on which the second protrusion extends from said face.

8. The device according to claim 5, wherein the insulating segment and the first portion are present on the same plane transverse with respect to an axis of displacement of the piston.

9. The device according to claim 5, wherein the insulating segment and the first portion are offset along an axis of displacement of the piston.

10. The device according to claim 1, wherein the device comprises:

a first pyrotechnic switch comprising a first pyrotechnic initiator and a first movable piston comprising a lower face from which the first protrusion protrudes, and a second pyrotechnic switch, separate from the first pyrotechnic switch, comprising a second pyrotechnic initiator and a second movable piston comprising a lower face from which the second protrusion protrudes.

11. The device according to claim 10, wherein the device comprises a control device which is configured to actuate the first pyrotechnic switch and the second pyrotechnic switch when it detects an intensity of the current circulating in the first portion greater than a first threshold value, and the control device being further configured to actuate only the first pyrotechnic switch when it detects an intensity of the current circulating in the first portion comprised between a second threshold value and the first threshold value, the second threshold value being lower than the first threshold value.

12. A secure electrical system comprising:

a secure supply system comprising:

an electrical circuit, and a cut-off device according to claim 1 connected to the electrical circuit, and an electrical device connected to said supply system and intended to be supplied by the latter.

13. The system according to claim 12 wherein the system further comprises an electric generator configured to supply the circuit with an electric current having a first intensity, the rating of the first fuse element being less than or equal to this first intensity.

14. An electrical installation comprising a secure electrical system according to claim 12.

* * * * *